US010577233B2

(12) United States Patent
Abreu

(10) Patent No.: US 10,577,233 B2
(45) Date of Patent: Mar. 3, 2020

(54) CAN PUNCTURING DEVICE AND METHOD

(71) Applicant: Odilio Abreu, Toronto (CA)

(72) Inventor: Odilio Abreu, Toronto (CA)

( * ) Notice: Subject to any disclaimer, the term of this patent is extended or adjusted under 35 U.S.C. 154(b) by 0 days.

(21) Appl. No.: 15/875,328

(22) Filed: Jan. 19, 2018

(65) Prior Publication Data

US 2019/0225472 A1 Jul. 25, 2019

(51) Int. Cl.
*B67B 7/00* (2006.01)

(52) U.S. Cl.
CPC ..... *B67B 7/24* (2013.01); *B65D 2517/002* (2013.01); *B65D 2517/0005* (2013.01)

(58) Field of Classification Search
CPC .... B67B 7/24; B67B 7/26; B67B 7/28; B65D 2517/002; B65D 2517/0004; B65D 2517/0005; B65D 17/30; Y10T 83/0481; Y10S 220/906; A23L 2/52; A23L 2/56; A23L 2/60
USPC ..... 30/446–448
See application file for complete search history.

(56) References Cited

U.S. PATENT DOCUMENTS 1,452,287 A * 4/1923 Burke ..... B67B 7/24 126/99 R
1,577,957 A * 3/1926 Dalmas ..... B67B 7/24 30/447
1,866,642 A * 7/1932 Geer ..... B67B 7/24 232/6
2,059,367 A * 11/1936 Kittle ..... B67B 7/24 30/414
2,135,116 A * 11/1938 Shaffer ..... B67B 7/24 30/448
2,406,831 A * 9/1946 Hansen ..... B67B 7/24 220/278
2,411,344 A * 11/1946 Singer ..... B67B 7/24 30/446

(Continued)

FOREIGN PATENT DOCUMENTS

FR 2036742 * 12/1970 ..... B67B 7/24
GB 1103805 A * 2/1968 ..... B67B 7/24

OTHER PUBLICATIONS

Michael Coan, How to Drain Cans, http://popcan.org/drain.html, Feb. 2015, pp. 1-3 (Year: 2015).*

(Continued)

*Primary Examiner* — Evan H Macfarlane
(74) *Attorney, Agent, or Firm* — Kagan Binder, PLLC

(57) ABSTRACT

A device for puncturing a metal can having a cylindrical sidewall and a bottom portion with an annular concave central portion terminating in an annular base portion. The base has an annular inclined connecting wall portion extending outward from the annular base portion to the sidewall. The device includes a frame with vertical walls extending above a supporting surface to a height at least equal to the height of the metal can, and an arm rotatably attached to the walls. The arm has two or more puncturing elements extending downward when the arm is in a puncturing position in which the arm extends laterally. The puncturing elements are configured so the can is positionable upside-down on a supporting surface so that when the arm is rotated into the puncturing position, the first puncturing element punctures the connecting wall and the second puncturing element punctures the concave central portion.

16 Claims, 8 Drawing Sheets

(56) References Cited

U.S. PATENT DOCUMENTS

| | | | | |
|---|---|---|---|---|
| 2,516,746 | A * | 7/1950 | Barlow | B67B 7/24 30/447 |
| 2,556,731 | A * | 6/1951 | Lapierre | B67B 7/24 30/447 |
| 2,621,401 | A * | 12/1952 | Briner | B67B 7/24 30/447 |
| 2001/0022305 | A1* | 9/2001 | Cavella | B65D 17/4012 220/257.2 |
| 2010/0101102 | A1* | 4/2010 | Tofte | B67B 7/24 30/443 |
| 2014/0237952 | A1* | 8/2014 | Fesler | B67B 7/16 53/492 |

OTHER PUBLICATIONS

Archive.org achival of popcan.org/drain.html, https://web.achive.org/20150222101950/http://popcan.org/drain.html, Mar. 2019 (Year: 2019).*

Make a Soda Can Stove, https://www.thereadystore.com/survival-tips/7951/make-a-stove-out-of-a-soda-can/ (Year: 2015).*

Helvetia Packaging, https://www.helvepa.com/en/products (Year: 2016).*

Archive.org capture of Helvetia Packaging page, https://web.archive.org/web/20161208015923/https://www.helvepa.com/en/products (Year: 2016).*

* cited by examiner

500

CAN PUNCTURING DEVICE AND METHOD

FIELD OF THE INVENTION

The present invention relates generally to devices and methods for puncturing metal cans, and more particularly to devices and methods for puncturing the bases of metal cans to facilitate the consumption of liquid in the cans.

BACKGROUND OF THE INVENTION

Many beverages are sold in metal cans, such as beer and soft drinks. In some cases, users may wish to add flavoring to the beverage, or such flavoring (e.g. lime juice) may be included in the contents of the can by the manufacturer. Because of the limited size of the opening of such cans, though which users normally drink the contents of the can, it can be difficult or inconvenient for a user to add flavoring directly to a can.

SUMMARY OF THE INVENTION

The invention provides a puncturing device for puncturing a metal can positioned on a supporting surface. The metal can has a cylindrical sidewall having a first diameter about a central axis and has a bottom portion. The bottom portion includes an annular/circular concave dome-shaped central portion extending radially outwardly from the central axis and terminating in an annular base portion. The annular base portion is spaced axially apart from the sidewall and has a second diameter about the central axis. The second diameter is less than the first diameter. The bottom portion also includes an annular inclined connecting wall portion extending outward from the annular base portion to the sidewall. The metal can has a height that is the vertical distance of the annular base portion of the metal can above the supporting surface when the metal can is positioned upside-down on the supporting surface. The puncturing device includes a frame and an arm. The frame has one or more vertical walls extending vertically above the supporting surface, perpendicular to the supporting surface, to a height at least equal to the height of the metal can. An upper portion of one or more of the vertical walls provides an arm support. The arm is rotatably attached to the arm support, and has first and second puncturing elements extending downward when the arm is in a puncturing position in which the arm extends laterally, parallel to the supporting surface. The puncturing elements are spaced apart from each other. They are positioned and configured so that the metal can is positionable upside-down on the supporting surface with the sidewall extending vertically above the supporting surface and the annular base portion above the sidewall, so that when the arm is rotated from a position above the metal can to the puncturing position, the first puncturing element punctures the connecting wall portion of the metal can and the second puncturing element punctures the concave dome-shaped central portion of the metal can.

The arm further preferably includes a third puncturing element configured so that when the metal can is positioned so that when the arm is rotated from a position above the metal can to the puncturing position, the first puncturing element punctures the connecting wall portion of the metal can, and the second puncturing element punctures the concave dome-shaped central portion of the metal can, then the third puncturing element extends downward and also punctures the concave dome-shaped central portion of the metal can. The concave dome-shaped central portion of the metal has a center point, and the arm may be configured so that when the arm is rotated into the puncturing position, the second and third puncturing elements puncture second and third holes in the concave dome-shaped central portion of the metal can, and the second and third holes are spaced away from each other and spaced away from the center point.

The frame may have two opposing vertical walls spaced apart from each other by a distance greater than the first diameter. The arm may be rotatably attached to the vertical walls by a pin extending through the distal end of the arm and through holes in the upper portions of the vertical walls so that the holes provide the arm support. The proximal end of the arm may provide a handle for a user to grasp in order to rotate the arm from a position above the metal can into the puncturing position. The frame preferably also includes a can positioning element attached to the vertical walls and extending laterally between the vertical walls below the arm. The can positioning element has a can engaging end and is configured so that when the metal can is positioned upside-down on the supporting surface with the sidewall extending vertically above the supporting surface and the annular base portion is above the sidewall, then the sidewall engages the can engaging end and constrains the position of the metal can so that when the arm is rotated into the puncturing position, the first puncturing element penetrates the connecting wall portion of the metal can and the second puncturing element penetrates the concave dome-shaped central portion of the metal can. The frame may also include a base having upper and lower sides, the base being between and attached to the vertical walls, the upper side of the base comprising the supporting surface, the lower side of the base being configured to rest on a flat surface. The base may be adjustable to vary the vertical distance between the upper side of the base and the arm when the arm is in the puncturing position so as to accommodate metal cans of varying heights. The can engaging end is preferably arcuate with a curvature comparable to curvature of the sidewall of the metal can.

The first puncturing element may be a stainless steel spike configured to create a first hole in the connecting wall portion of the metal can having a diameter of between 3 mm and 8 mm, and the second puncturing element may be a spike configured to create a second hole in the concave dome-shaped central portion of the metal can having a diameter of between 1 mm and 5 mm. The first puncturing element may be configured to create the first hole in the connecting wall portion of the metal can having a diameter of between 3 mm and 6 mm, and the second puncturing element may be a spike configured to create the second hole in the concave dome-shaped central portion of the metal can having a diameter of between 1 mm and 3 mm.

The invention also provides a method of puncturing a metal can. The metal can has a cylindrical sidewall having a first diameter about a central axis and has a bottom portion. The bottom portion includes an annular concave dome-shaped central portion extending radially outwardly from the central axis and terminating in an annular base portion. The annular base portion is spaced axially apart from the sidewall and has a second diameter about the central axis. The second diameter is less than the first diameter. The bottom portion also includes an annular inclined connecting wall portion extending outward from the annular base portion to the sidewall. The method includes providing first and second puncturing elements, the first puncturing element configured to puncture the metal can to produce a hole having a diameter of between 3 mm and 8 mm, the second puncturing element configured to puncture the metal can to produce a hole having a diameter of between 1 mm and 5 mm. Then the method includes the step of puncturing the connecting wall portion of the bottom portion with the first puncturing element to produce a first hole having a diameter of between 3 mm and 8 mm, and puncturing the concave central portion of the bottom portion with the second puncturing element to produce a second hole having a diameter of between 1 mm and 5 mm.

The metal can may be an aluminum can containing a beverage, and the method may further include, while the aluminum can is upside-down, placing flavoring fluid in the concave central portion, and drinking a mixture of the beverage and the flavoring fluid via the first hole. The beverage and the flavoring fluid mix via fluid communication through the second hole. The beverage may be beer and the flavoring fluid may be lime juice. Puncturing the connecting wall portion of the bottom portion and puncturing the concave central portion of the bottom portion are preferably done by using the puncturing device described above.

The invention further provides a puncturing device for puncturing a metal can positioned on a supporting surface. The metal can has a cylindrical sidewall having a first diameter disposed around a central axis, and a bottom portion. The bottom portion includes an annular concave dome-shaped central portion extending radially outwardly from the central axis and terminating in an annular base portion. The annular base portion is spaced axially apart from the sidewall and has a second diameter about the central axis. The second diameter is less than the first diameter. The bottom portion also includes an annular inclined connecting wall portion extending outward from the annular base portion to the sidewall. The puncturing device has an arm that is rotatably attached to a vertical support, the arm having first and second puncturing elements that extend downward when the arm is in a puncturing position in which the arm extends laterally from the vertical support. The puncturing elements are spaced apart from each other and positioned so that the metal can is positionable upside-down on the supporting surface with the sidewall extending vertically above the supporting surface and the annular base portion above the sidewall, so that when the arm is rotated from a position above the metal can to the puncturing position, the first puncturing element punctures the connecting wall portion of the metal can and the second puncturing element punctures the concave dome-shaped central portion of the metal can. The arm preferably includes a third puncturing element, where the third puncturing element is configured so that when the metal can is positioned so that when the arm is rotated from a position above the metal can to the puncturing position, the first puncturing element punctures the connecting wall portion of the metal can, and the second puncturing element punctures the concave dome-shaped central portion of the metal can, then the third puncturing element extends downward and also punctures the concave dome-shaped central portion of the metal can. The concave dome-shaped central portion of the metal can has a center point, and the arm may be configured so that when the arm is rotated into the puncturing position, the second and third puncturing elements puncture second and third holes in the concave dome-shaped central portion of the metal can, the second and third holes being spaced away from each other and spaced away from the center point. The puncturing device may also include a can positioning element extending laterally from the vertical support below the arm to a can engaging end. The can positioning element is configured so that when the metal can is positioned upside-down on the supporting surface with the sidewall extending vertically above the supporting surface and the annular base portion above the sidewall, and the sidewall of the metal can engages the can engaging end, thereby constraining the position of the metal can, then when the arm is rotated into the puncturing position, the first puncturing element penetrates the connecting wall portion of the metal can and the second puncturing element penetrates the concave dome-shaped central portion of the metal can. The can engaging end is preferably arcuate with a curvature comparable to curvature of the sidewall of the metal can.

DETAILED DESCRIPTION OF THE INVENTION

Figure 1:
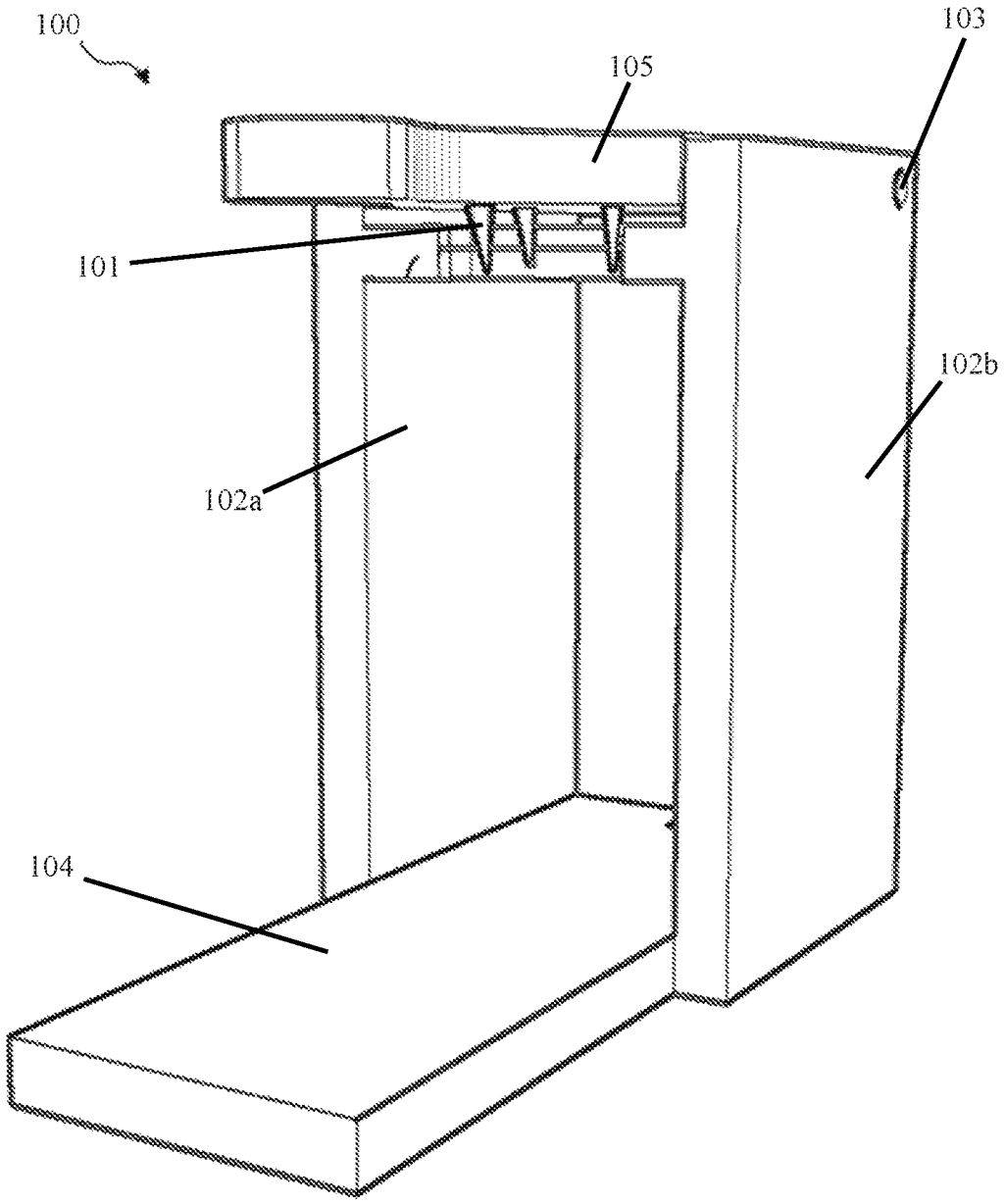
FIG. 1 is a front perspective view of an embodiment of a puncturing device with the arm in the puncturing position, without a can.
Figure 2:
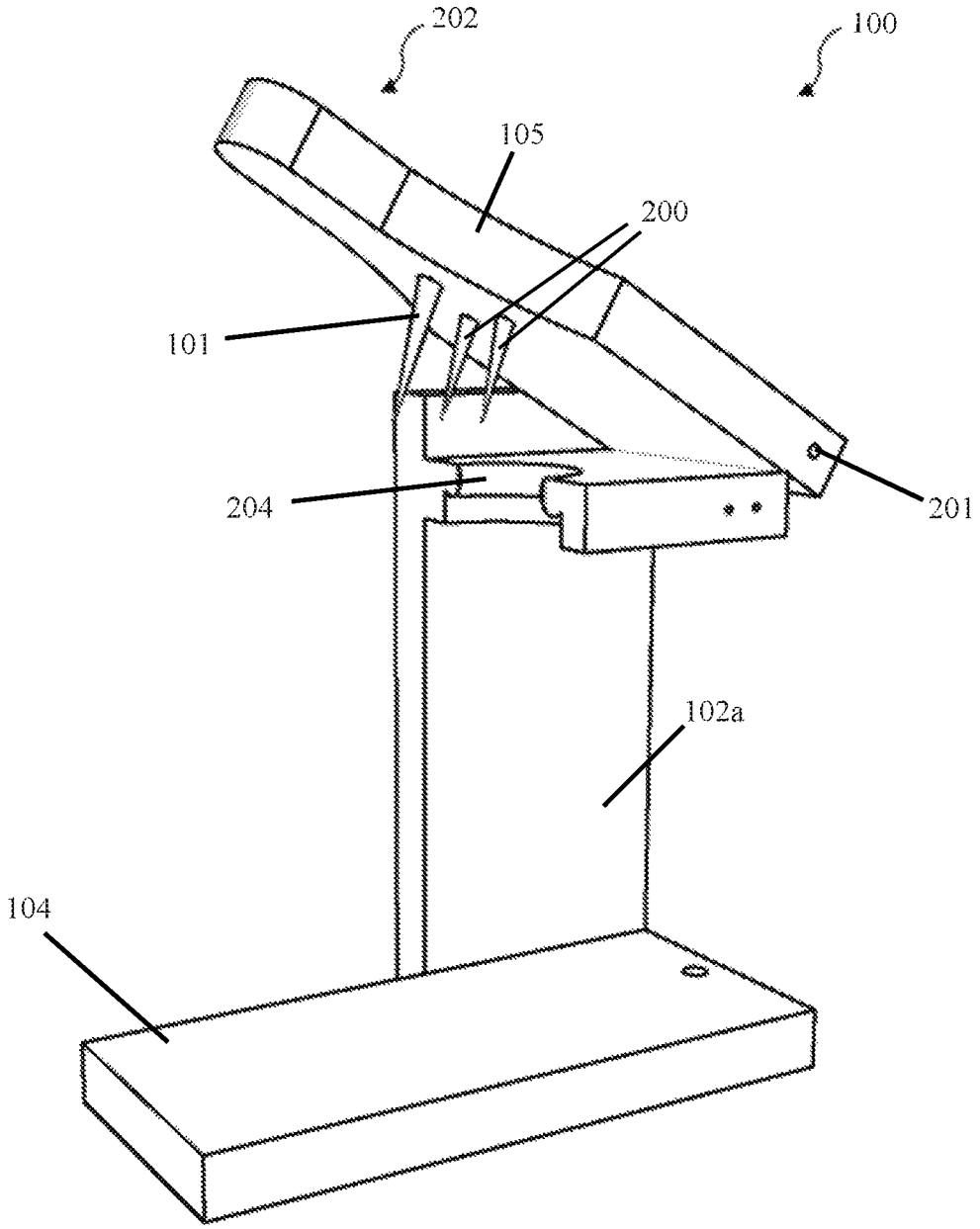
FIG. 2 is a side perspective view of the puncturing device of FIG. 1 with the arm positioned above the puncturing position, without a can and with the right vertical wall removed.
Figure 3:
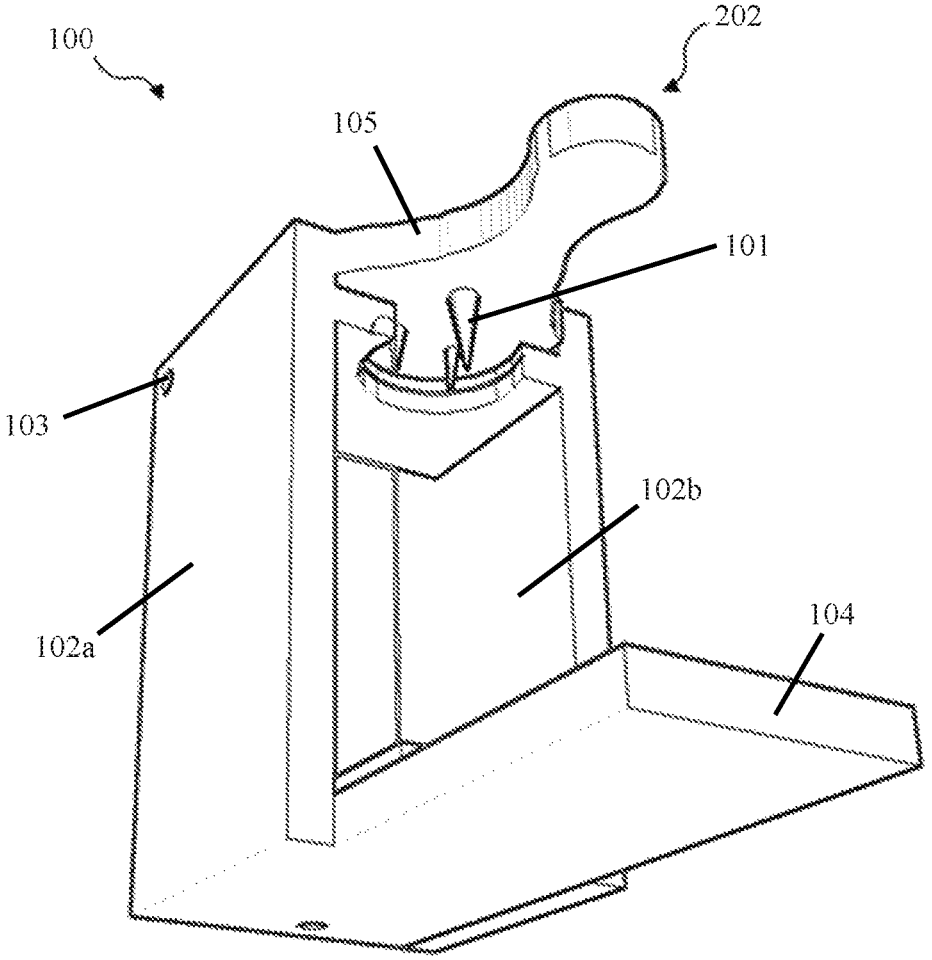
FIG. 3 is a lower front perspective view of the puncturing device of FIG. 1 with the arm positioned in the puncturing position, without a can.
Figure 4:
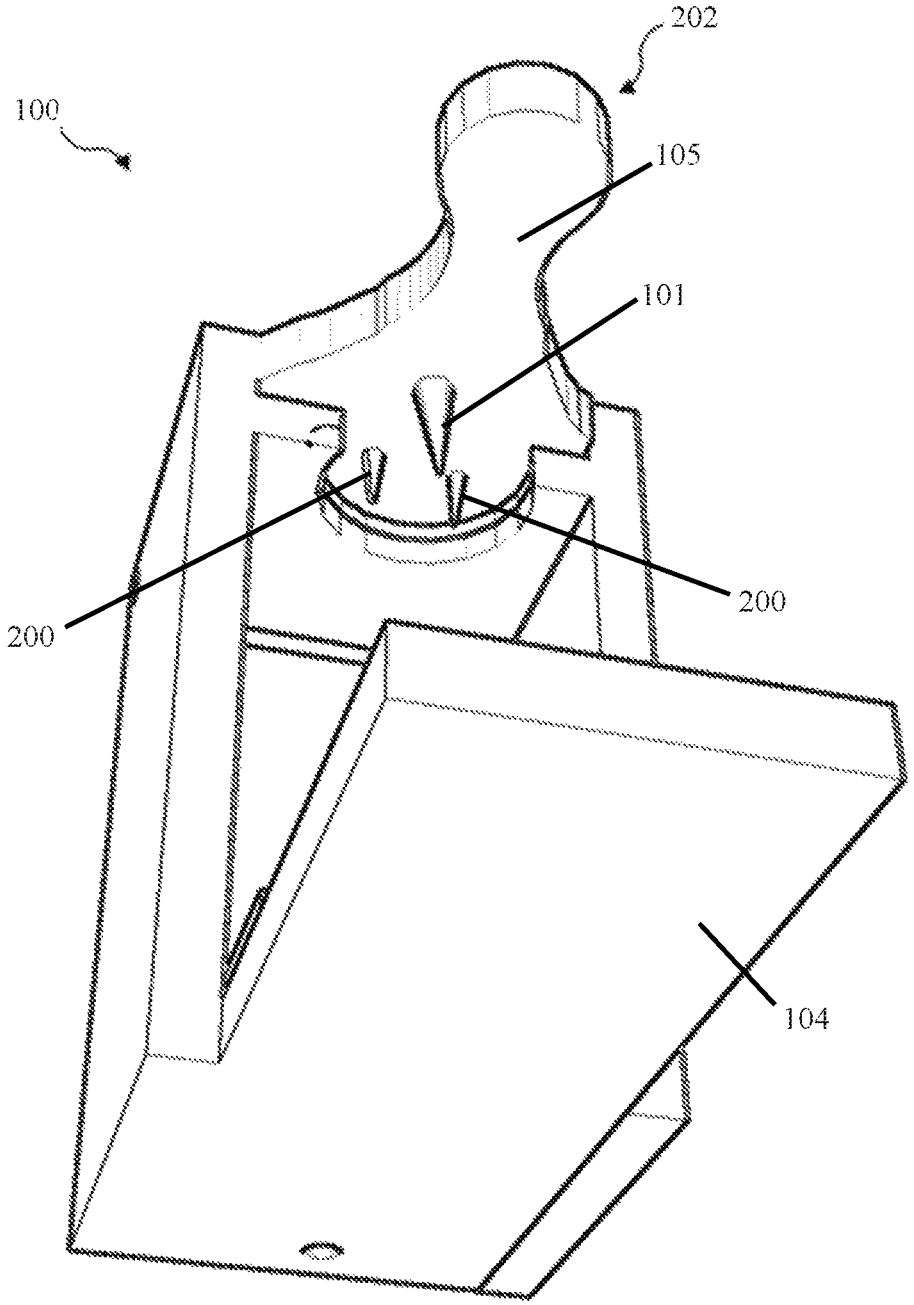
FIG. 4 is another lower front perspective view of the puncturing device of FIG. 1 with the arm positioned in the puncturing position, without a can.
Figure 5:
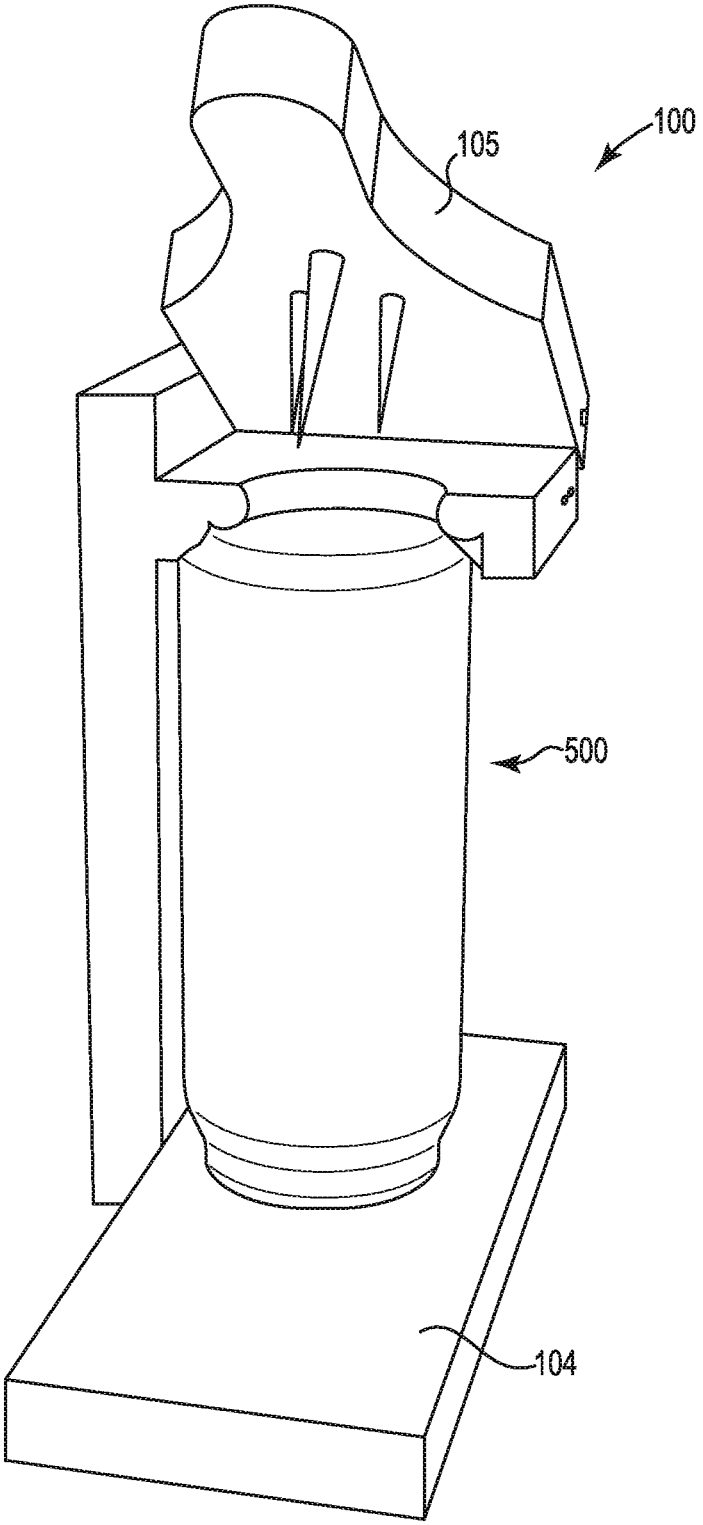
FIG. 5 is a side perspective view of the puncturing device of FIG. 1, with the right vertical wall removed, and with the arm positioned above the puncturing position, with a can on the base.
Figure 6:
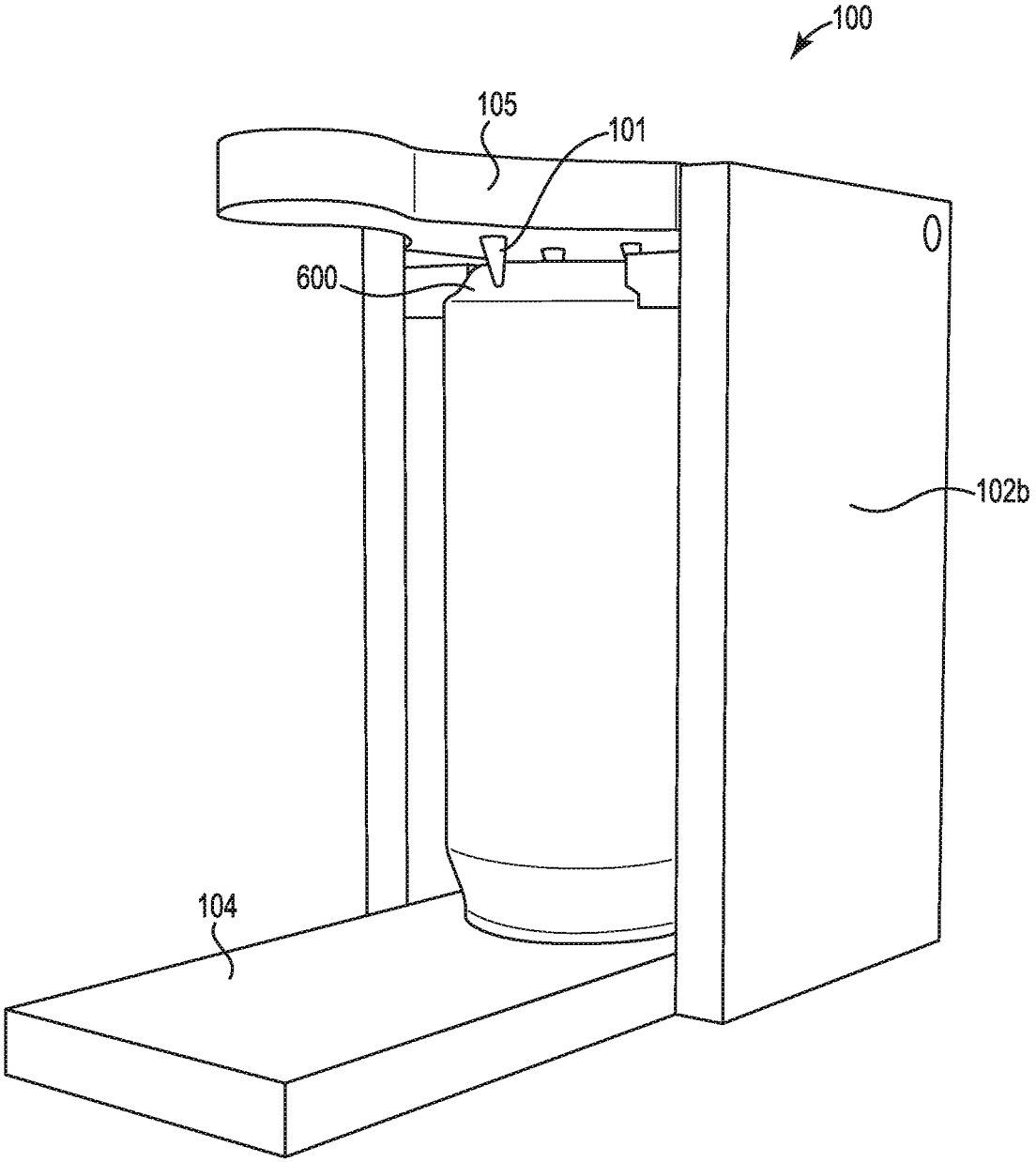
FIG. 6 is a side perspective view of the puncturing device of FIG. 1 with a can on the base and the arm positioned in the puncturing position.

A preferred embodiment of the puncturing device 100 is depicted in FIGS. 1-6 and 9. FIGS. 5 and 6 show a can 500 resting upside-down on the supporting surface 104. In FIGS. 2 and 5, the right vertical wall 102*b* is not shown. An upside-down can 500 is shown in FIG. 7, and the same can is shown in FIG. 8 after the base portion of the can has been punctured by the puncturing device 100.

The can 500 is typically a common aluminum can used to hold beverages such as beer, carbonated soft drinks (pop/soda) and fruit juice. Such cans have a sidewall 703, a bottom portion and a top portion 704. The sidewall 703 is cylindrical and has a first diameter about a central axis. The circular top portion 704 is generally narrower than the sidewall 703 and has a mechanism (not shown) for opening the can. This is typically a stay-tab opening mechanism.

Figure 7:
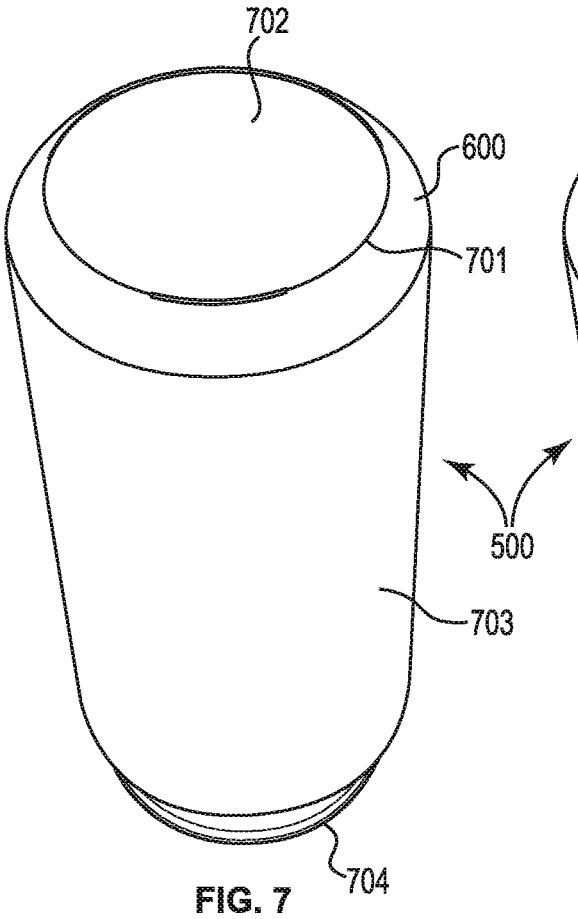
FIG. 7 is a perspective view of an upside-down can showing the bottom portion of the can.
Figure 8:
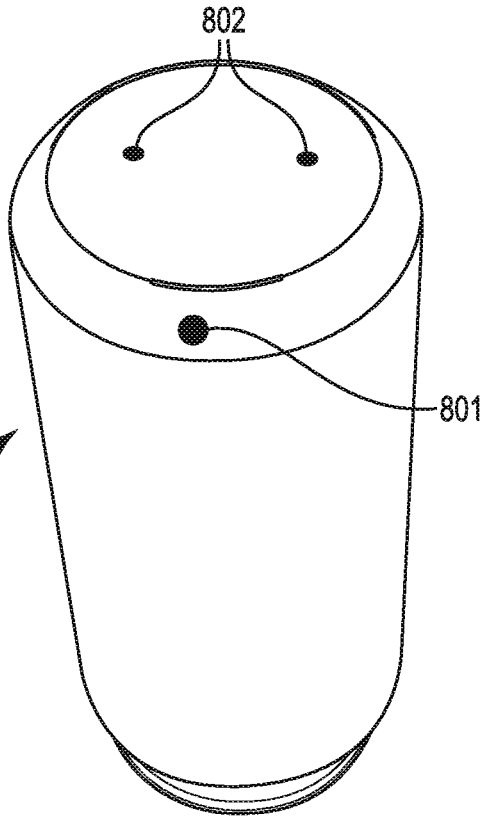
FIG. 8 is a view of the bottom portion of can of FIG. 7 with the bottom of the can having been punctured using the device of claim 1.

The bottom portion of such cans has largely become standardized, As shown in FIG. 7, the bottom portion has an annular concave dome-shaped central portion 702. The "dome" extends inward towards the interior of the can 500 and terminates in an annular base portion 701. An annular inclined connecting wall portion 600 extends outward from the annular base portion 701 to the sidewall 703. The annular base portion 701 has a second diameter about the central axis which is smaller than the first diameter. The inclined connecting wall portion 600 is inclined and configured to bridge the narrower annular base portion 701 and the wider lower end of the sidewall 703. The annular base portion 701 lies in a plane perpendicular to the sidewall 703 so that the can is able to rest stably on a flat surface when the can 500 is placed with the annular base portion 701 on a flat surface, such as a shelf or a table.

In normal use, such a can 500 is filled with a beverage and placed on a surface or held so that it is "right-side-up"—i.e. with the sidewall extending vertically up from the base portion to the top portion 704 (the opposite of the orientation shown in the figures). A user can then open the stay-tab, creating an opening in the top portion through which the user can drink contents of the can by placing the users' lips around the opening and tilting the can. Alternatively, the contents of the can may be poured into a drinking vessel by tilting the opened can.

In contrast, the present invention is designed to facilitate drinking the contents of such a can through a hole in the bottom portion of the can. The drinking hole 801 produced in the inclined connecting wall portion 600 of the base portion of the can 500 by the present invention serves as a drinking hole. The puncturing device also produces one or two or more auxiliary holes 802 in the concave dome-shaped central portion 702 of the can 500. Such auxiliary holes 802 serve two purposes. First, they allow air to enter the can so that fluid can easily flow from the interior of the can 500 though the drinking hole 801 when the user's lips surround the drinking hole 801 and the user tilts the can 500. For example, the user could simply drink the contents of the can 500 in this manner.

The second purpose of the auxiliary holes 802 is to allow the user to mix flavoring with the contents of the can 500. For example, if the can contains beer, the user may wish to mix lime juice with the beer. This can be done by pouring some liquid flavoring, such as lime juice, into the dome-shaped central portion 702 of the can 500 after the can has been punctured and is sitting upside down, as in FIG. 8. The auxiliary holes 802 permit the flavoring liquid in the dome-shaped central portion 702 to pass through the auxiliary holes 802 naturally by the force of gravity to mix with the contents of the can 500 so that the user can drink a mixture of the contents of the can 500 and the flavoring liquid The user may obtain more of the flavoring liquid by placing his or her upper lip beyond the annular base portion 701 with the lower lip below the drinking hole 801 so that some of the flavoring in the dome-shaped central portion 702 enters the user's mouth directly from the dome-shaped central portion 702 as the user tilts the can 501 and drinks the contents of the can 500 through the drinking hole 801.

In addition to flavoring liquid, the user may place other items, such as salt into the flavoring liquid in the dome-shaped central portion 702, the flavoring liquid may dissolve other flavored items (e.g. salt) and by gravity will go through the auxiliary holes 802 and mix with the contents of the can 500. The user can put as little or as much such flavoring liquid in the dome-shaped central portion 702 as the user wishes. Although the volume of flavoring liquid that can be placed in the dome-shaped central portion 702 at one time is limited by the volume of the reservoir formed by the dome-shaped central portion 702 of the bottom portion of the can 500, the user is free to replenish the flavoring liquid in the flavoring liquid once some or all of the liquid has been consumed.

The preferred approach to producing the drinking hole 801 in the inclined connecting wall portion 600 of the base portion of the can 500 and the one or more auxiliary holes 802 in the concave dome-shaped central portion 702 of the base portion of the can 500 is to use a device 100 as shown in FIGS. 1-6 and 9.

In the depicted preferred embodiment, the puncturing device 100 has two vertical walls 102*a*, 102*b*, a base 104 between the two walls, and an arm 105 rotatably attached to an arm support 103 provided by the vertical walls 102*a*, 102*b*. The arm 105 is rotatable from an upper position above the vertical walls (e.g. FIG. 2) to a puncturing position perpendicular to the vertical walls where the arm extends laterally as shown in FIG. 1. The depicted embodiments employ can positioning element 204 which is attached to the vertical walls and extends laterally between the vertical walls perpendicular to the walls below the arm 105. The can positioning element 204 both serves to assist a user in positioning a can 500 in the puncturing device 100 and to limit the downward rotation of the arm 105.

The can positioning element 204 has a can engaging end with an arcuate portion for engaging the sidewall of the can having a curvature comparable to curvature of the sidewall of the metal can. In order to use the puncturing device 100, the user first ensures that the arm 105 is in an open position with the arm above the vertical walls 102*a*, 102*b* and can positioning element 204, and then places a can 500 upside down on the base 104 so that the top of the can sits on the base 104 which acts as a supporting surface for the can 500. The can is then positioned as shown in FIG. 5, by moving the can, e.g. by sliding the can along the base 104, so a portion of its sidewall engages with the can engaging end (as shown in FIG. 5) to constrain the position of the metal can in a puncturing position.

The arm 105 has one larger puncturing element 101 and two smaller puncturing elements 200 as shown in the figures. The puncturing elements may be, for example, stainless steel spikes. The spikes are placed so that when a can is in the puncturing position, and the arm is rotated from above the can (see FIG. 5) into the puncturing position (see FIG. 6), the spikes will engage and puncture specific portions of the bottom portion of the can.

In particular, the larger puncturing element 101 is configured and positioned to puncture the inclined connecting wall portion 600 of the base portion of the can 500 to produce a drinking hole 801. The larger puncturing element 101 is preferably configured to produce a drinking hole 801 having a diameter of between 3 mm and 8 mm, or in some embodiments of between 3 mm and 6 mm. Each smaller puncturing element 200 is configured and positioned to puncture the concave dome-shaped central portion 702 of the can 500, for example to produce an auxiliary hole 802 having a diameter of between 1 mm and 5 mm, or in some embodiments of between 1 mm and 3 mm. In either embodiments, larger or smaller holes may be formed. The puncturing elements 101, 200 may be generally perpendicular with the arm 105 as shown, or any or all of these elements may be disposed at an angle.

The arm 105 preferably has a handle portion 202 at the proximal end of the arm 105 with the arm being rotatably attached to the vertical walls of the frame towards the distal end. This may be done, for example, by a pin extending through an opening 201 in the distal end of the arm and through holes 103 in the upper portions of the vertical walls, the holes providing an arm support. The arm 105 can then be rotated about the pin by the user grasping and raising or lowering the handle 202 of the arm 105. Generally, when a can 500 is resting upside-down on the supporting surface 104 with the handle 202 of the arm 105 above the bottom portion of the can 500 and the can engaged with the can positioning element 204, the user can simply rotate the arm 105 down to the puncturing position, thereby puncturing the bottom portion of the can 500, and then raise the arm 105 back up so that the can may be removed. The position of the puncturing elements, with the can in engagement with the can positioning element 204, ensures that the holes made in the bottom portion of the can 500 are in the correct places. The rotational position of the can 500 is functionally irrelevant because the bottom portion of the can 500 is rotationally symmetric, although the user can control the placement of the drinking hole 801 by rotating the can 500 while it is engaged with the can positioning element 204.

As can be seen in FIG. 5, the can positioning element 204 may have upper and lower portions where the lower arcuate portion engages (i.e. abuts) a portion of the sidewall of the can, and a upper overhanging portion at a height selected to that the upper portion is proximate to the annular base portion 701. The can positioning element 204 may also have an inclined portion below the upper portion with an inclination matching the inclination of the inclined connecting wall portion 600 of the can 500 so as to provide a good fit between the bottom and sidewall of the can when the can engages the can positioning element 204.

Figure 9:
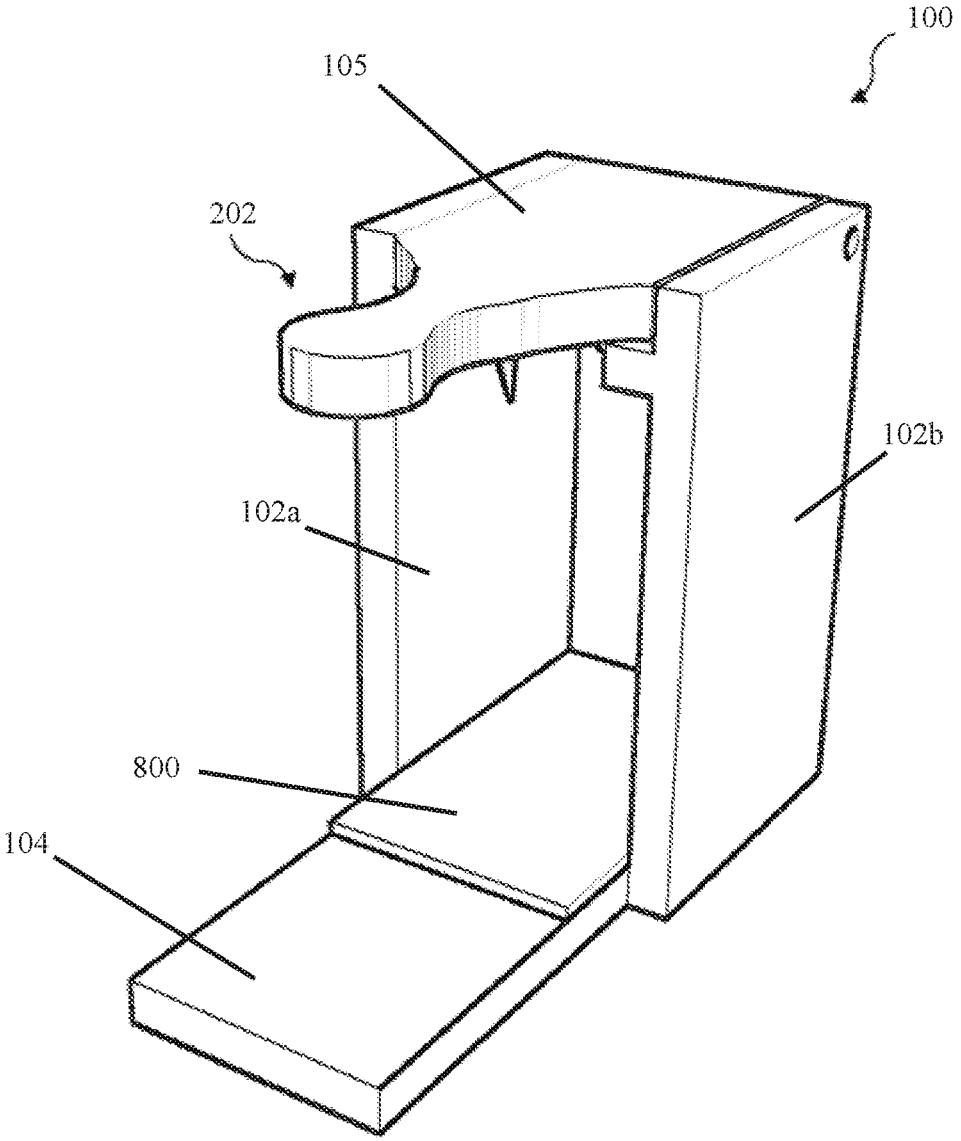
FIG. 9 is a side perspective view of the puncturing device of FIG. 1 with an augmented base, and with the arm positioned in the puncturing position, without a can.

The base of the frame may be adjustable to accommodate cans of varying heights. For example, a step 800 as shown in FIG. 9 may be placed on the base 104 to handle cans of reduced height, ensuring that when the can and the arm are in their respective puncturing positions, then the puncturing elements will puncture the base of the can to create holes of the desired diameters.

While the depicted embodiments employ two vertical side walls forming a frame, various other configurations are also possible. In some configurations, the frame may also have a back wall extending vertically from the base to the distal end of the arm. In some configurations, the frame may include only a back wall where the back wall provides the arm support.

The abbreviation mm as used herein refers to millimetres (or in the US, "millimeters").

It should be understood that the above-described embodiments of the present invention, particularly, any "preferred" embodiments, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

The scope of the claims that follow is not limited by the embodiments set forth in the description. The claims should be given the broadest purposive construction consistent with the description and figures as a whole.

What is claimed is:

1. In combination, a puncturing device and a metal can containing a beverage, the metal can comprising:

a cylindrical sidewall having a first diameter disposed around a central axis; and a bottom portion comprising:

a circular concave dome-shaped central portion extending radially outwardly from the central axis and terminating in an annular base portion spaced axially apart from the sidewall and having a second diameter disposed around the central axis and less than the first diameter, the concave dome-shaped central portion containing a flavoring fluid; and an annular inclined connecting wall portion extending between the concave dome-shaped central portion and the sidewall, the metal can having a height, the puncturing device comprising:

a frame comprising one or more vertical walls extending vertically above a supporting surface, perpendicular to the supporting surface, to a height at least equal to the height of the metal can, an upper portion of each of the one or more of the vertical walls providing an arm support; and an arm rotatably attached to the arm support, the arm having a lower surface, the arm comprising first and second puncturing elements extending downward from a flat portion of the lower surface of the arm when the arm is in a puncturing position in which the arm extends laterally, parallel to the supporting surface, wherein the puncturing elements are spaced apart from each other, and are positioned and configured so that the metal can is positionable upside-down on the supporting surface with the sidewall extending vertically above the supporting surface and the annular base portion above the sidewall, so that when the arm along with the puncturing elements are rotated from a position above the metal can to the puncturing position, the first puncturing element punctures the connecting wall portion of the metal can to create a single drinking hole and the second puncturing element punctures the concave dome-shaped central portion of the metal can to create a second hole, wherein the user can thereby drink a mixture of the beverage contained in the metal can and the flavoring fluid in the concave dome-shaped central portion via the drinking hole, wherein the beverage and the flavoring fluid mix via fluid communication through the second hole.

2. The combination of claim 1, wherein the arm further comprises a third puncturing element, wherein the third puncturing element is configured so that when the metal can is positioned so that when the arm is rotated from the position above the metal can to the puncturing position, the first puncturing element punctures the connecting wall portion of the metal can to create the drinking hole, and the second puncturing element punctures the concave dome-shaped central portion of the metal can to create the second hole, and wherein the third puncturing element extends downward and also punctures the concave dome-shaped central portion of the metal can to create a third hole.

3. The combination of claim 2, wherein the concave dome-shaped central portion of the metal can has a center point, and the arm is configured so that when the arm is rotated into the puncturing position, the second and third puncturing elements puncture the second and third holes in the concave dome-shaped central portion of the metal can, wherein the second and third holes are spaced away from each other and spaced away from the center point.

4. The combination of claim 1, wherein the arm comprises proximal and distal ends, and the one or more vertical walls comprise two opposing vertical walls spaced apart from each other by a distance greater than the first diameter, wherein the arm is rotatably attached to the two opposing vertical walls by a pin extending through the distal end of the arm and through holes in the upper portions of the two opposing vertical walls, the holes in the upper portions providing the arm support, and wherein the proximal end of the arm provides a handle for the user to grasp in order to rotate the arm from the position above the metal can into the puncturing position.

5. The combination of claim 4, wherein the frame further comprises a can positioning element attached to the two opposing vertical walls and extending laterally between the two opposing vertical walls below the arm, the can positioning element having a can engaging end and being configured so that when the metal can is positioned upside-down on the supporting surface with the sidewall extending vertically above the supporting surface and the annular base portion above the sidewall, the sidewall of the metal can is engageable with the can engaging end to constrain the position of the metal can so that when the arm is rotated into the puncturing position, the first puncturing element penetrates the connecting wall portion of the metal can and the second puncturing element penetrates the concave dome-shaped central portion of the metal can.

6. The combination of claim 5, wherein the frame further comprises a base having upper and lower sides, the base being between and attached to the two opposing vertical walls, the upper side of the base comprising the supporting surface, the lower side of the base being configured to rest on a flat surface.

7. The combination of claim 5, wherein the can engaging end is arcuate with a curvature selected to engage the sidewall of the metal can.

8. The combination of claim 1, wherein the metal can is an aluminum can.

9. The combination of claim 1, wherein the first puncturing element is a stainless steel spike configured to create the drinking hole in the connecting wall portion of the metal can having a diameter of between 3 mm and 8 mm, and the second puncturing element is a second spike configured to create the second hole in the concave dome-shaped central portion of the metal can having a diameter of between 1 mm and 5 mm.

10. The combination of claim 9, wherein the first puncturing element is configured to create the drinking hole in the connecting wall portion of the metal can having a diameter of between 3 mm and 6 mm, and the second spike is configured to create the second hole in the concave dome-shaped central portion of the metal can having a diameter of between 1 mm and 3 mm.

11. In combination, a puncturing device and a metal can containing a beverage, the metal can having a cylindrical sidewall having a first diameter disposed around a central axis, and a bottom portion comprising:

a circular concave dome-shaped central portion extending radially outwardly from the central axis and terminating in an annular base portion spaced axially apart from the sidewall and having a second diameter disposed around the central axis and less than the first diameter, the concave dome-shaped central portion containing a flavoring fluid; and an annular inclined connecting wall portion extending outward from the annular base portion to the sidewall, the puncturing device comprising an arm rotatably attached to a vertical support, the arm comprising first and second puncturing elements that extend downward from a flat portion of a lower surface of the arm when the arm is in a puncturing position in which the arm extends laterally from the vertical support, wherein the puncturing elements are spaced apart from each other and positioned so that the metal can is positionable upside-down on a supporting surface with the sidewall extending vertically above the supporting surface and the annular base portion above the sidewall, so that when the arm along with the puncturing elements are rotated from a position above the metal can to the puncturing position, the first puncturing element punctures the connecting wall portion of the metal can to create a single drinking hole and the second puncturing element punctures the concave dome-shaped central portion of the metal can to create a second hole, wherein a user can thereby drink a mixture of the beverage contained in the metal can and the flavoring fluid in the concave dome-shaped central portion via the drinking hole, wherein the beverage and the flavoring fluid mix via fluid communication through the second hole.

12. The combination of claim 11, wherein the arm further comprises a third puncturing element, wherein the third puncturing element is configured so that when the metal can is positioned so that when the arm is rotated from the position above the metal can to the puncturing position, the first puncturing element punctures the connecting wall portion of the metal can, and the second puncturing element punctures the concave dome-shaped central portion of the metal can, and wherein the third puncturing element extends downward and also punctures the concave dome-shaped central portion of the metal can.

13. The combination of claim 12, wherein the concave dome-shaped central portion of the metal can has a center point, and the arm is configured so that when the arm is rotated into the puncturing position, the second and third puncturing elements puncture the second hole and a third hole in the concave dome-shaped central portion of the metal can, the second and third holes being spaced away from each other and spaced away from the center point.

14. The combination of claim 11, further comprising a can positioning element extending laterally from the vertical support below the arm to a can engaging end, the can positioning element being configured so that when the metal can is positioned upside-down on the supporting surface with the sidewall extending vertically above the supporting surface and the annular base portion above the sidewall, and the sidewall of the metal can engages the can engaging end, thereby constraining the position of the metal can, then when the arm is rotated into the puncturing position, the first puncturing element penetrates the connecting wall portion of the metal can and the second puncturing element penetrates the concave dome-shaped central portion of the metal can.

15. The combination of claim 14, wherein the can engaging end is arcuate with a curvature selected to engage the sidewall of the metal can.

16. The combination of claim 14, wherein the metal can is an aluminum can.

* * * * *